United States Patent [19]

Bowers, Jr. et al.

[11] 4,227,429

[45] Oct. 14, 1980

[54] SPANNER SOCKET WRENCH

[76] Inventors: William Bowers, Jr., 2425 Nassau St.; William L. Grooms, Jr., 3307 Lexington St., both of Sarasota, Fla. 33581

[21] Appl. No.: 933,277

[22] Filed: Aug. 14, 1978

[51] Int. Cl.[3] ..... B25B 13/48

[52] U.S. Cl. ..... 81/90 C

[58] Field of Search ..... 81/90 C, 121 A, 71

[56] References Cited

U.S. PATENT DOCUMENTS

| | | | |
|---|---|---|---|
| 1,314,012 | 8/1919 | Mowers | 81/90 C X |
| 2,659,256 | 11/1953 | Palmer | 81/90 C |
| 2,735,325 | 2/1956 | Rudd | 81/71 |
| 3,742,789 | 7/1973 | Rusk et al. | 81/90 C |
| 3,768,345 | 10/1973 | Barnes | 81/90 C |
| 3,953,097 | 4/1976 | Graham | 81/90 C X |

FOREIGN PATENT DOCUMENTS

| | | | |
|---|---|---|---|
| 21340 | of 1901 | United Kingdom | 81/90 C |

*Primary Examiner*—James G. Smith

*Attorney, Agent, or Firm*—Hauke and Patalidis

[57] ABSTRACT

A spanner socket wrench driveable by conventional socket wrench drivers and provided with a face having a pair of diametrically opposed pins held by means of set screws. A spring is disposed behind each pin so as to permit adjusting the amount of projection of the pin from the socket face by loosening the set screw, adjusting the free length of each pin to an appropriate value, and tightening the set screw. The spanner socket of the invention is particularly well adapted to install, adjust and remove rings, seals and like mechanical parts adapted for driving by spanner wrenches, and more particularly when they are disposed at the bottom of a recess or cavity.

4 Claims, 5 Drawing Figures

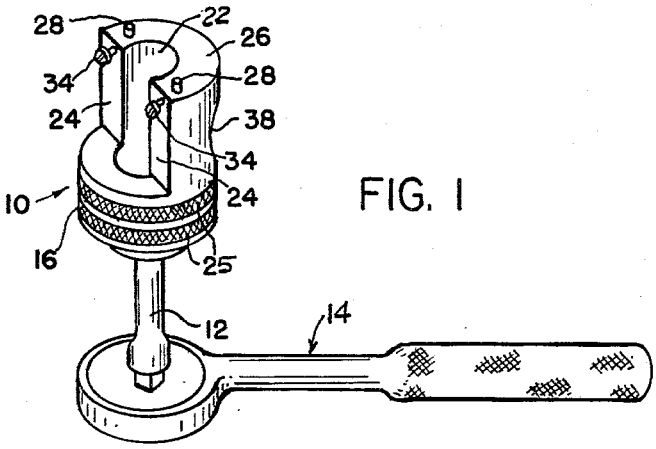
FIG. 1
FIG. 2
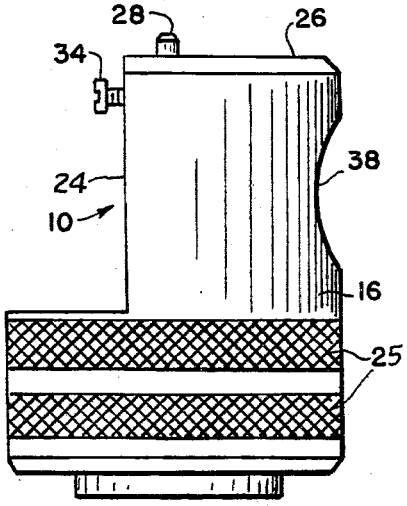
FIG. 3
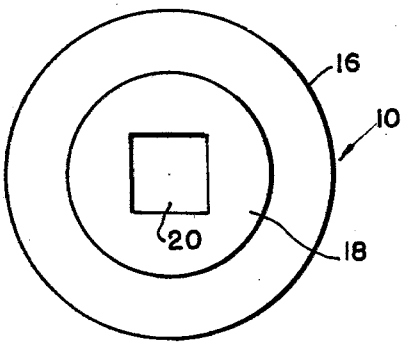
FIG. 4
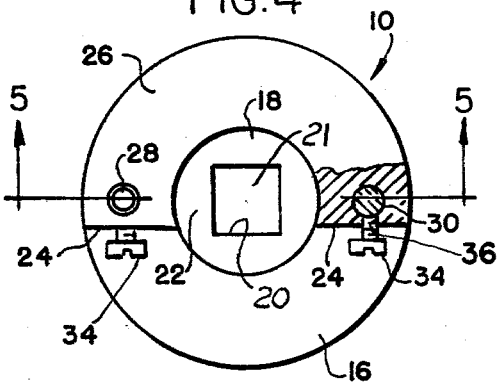
FIG. 5
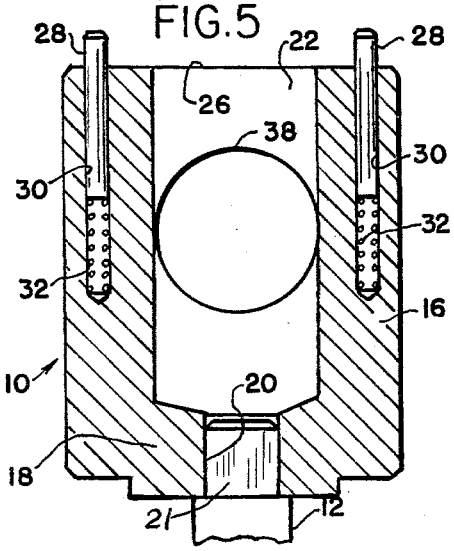

SPANNER SOCKET WRENCH

BACKGROUND OF THE PRESENT INVENTION

The present invention relates to improvements in spanner wrenches and similar tools, and more particularly to a structure for a spanner socket driveable by a conventional socket wrench driver and capable of reaching a mechanical part disposed at the bottom of a recess or cavity preventing access to the part by means of a conventional spanner wrench.

Many mechanical parts such as caps, plugs, rings, seals and the like are used in diverse mechanical assemblies, and are designed to be threaded and unthreaded, for example, by spanner wrenches provided with at least a pair of projecting pins engageable in appropriate recesses or apertures provided in an exposed side surface of the cap, plug, ring, seal, or the like.

In mechanical assemblies where a cap, plug, ring, seal or the like is disposed in a tubular member or at the bottom of a deep recess or cavity, as for example the steering seal rings in some motor vehicle steering mechanisms, or when trying to assemble or disassemble mechanical units having deeply recessed seal rings, adjusting rings, caps, and like mechanical parts which can be operated only by spanner wrenches, special spanner wrenches must specifically be designed for a particular assembly operation or repair operation.

The present invention provides a spanner wrench of universal use, in the form of a socket which can be driven by conventional socket wrench drivers and extensions usually available in conventional socket wrench tool sets, for operation on a mechanical part requiring a spanner wrench for assembling to other parts or for removing from an assembly. More particularly, the present invention provides spanner sockets which can be supplied commercially as a spanner socket set of diverse appropriate dimensions, and which are capable of operation not only on readily accessible mechanical parts but, more particularly, on mechanical parts disposed in a tubular member or disposed at the bottom of a deep recess or cavity, thus making such parts unaccessible to conventional spanner wrenches.

SUMMARY OF THE INVENTION

The invention accomplishes its objects and purposes by means of a socket in the form of a cylindrical tubular body provided at one end with a square, hexagonal or the like opening for fitting by a corresponding, square, hexagonal or the like end of the drive bar of a socket wrench driver, and having at its other end a pair of diametrically disposed longitudinal projecting adjustable pins, held in an appropriate position by means of set screws.

BRIEF DESCRIPTION OF THE DRAWING

The many objects and advantages of the present invention will become apparent to those skilled in the art when the following description of the best mode contemplated for practicing the invention is read in conjunction with the accompanying drawing wherein:

FIG. 1 is a perspective view of an example of a spanner socket wrench according to the present invention mounted on the end of a conventional socket wrench driver;

FIG. 2 is a side elevation view thereof;

FIG. 3 is a bottom end view thereof;

FIG. 4 is a top elevation view thereof, with a portion removed to show the internal construction; and FIG. 5 is a longitudinal section thereof along line 5—5 of FIG. 4.

DETAILED DESCRIPTION OF THE INVENTION

Referring now to the drawing and more particularly to FIG. 1 thereof, a spanner socket wrench 10 according to the present invention is shown mounted on the driving end of an extension bar 12 driven in turn by a conventional socket wrench driver 14. The spanner socket 10, as also illustrated at FIGS. 2—5, is in the form of a tubular steel or cast iron body 16 provided on one end with an end wall 18 having a square aperture 20 at its center for engagement by the corresponding square end 21 of a driving member, such as the extension 12, FIG. 5, available in conventional socket wrench sets, or directly by the square end of a socket wrench driver such as the driver 14, FIG. 1, where no extension is required. The other end of the tubular body 16 is open, as shown at 22, and a portion of the cylindrical wall of the body is cut away such as to form a pair of substantially co-planar longitudinally disposed lateral faces 24. Preferably, the peripheral surface of the body 16 is provided with serrations or knurls, as shown at 26 at FIGS. 1 and 2, to facilitate manual grasp of the body 16.

As best shown at FIGS. 1, 4 and 5, the tubular body 16, as a result of being provided with a cut-away portion, has a partially annular end face 26 of a length extending more than a 180° arc around the longitudinal axis of the tubular body 16. A pair of pins 28 project longitudinally from the partially annular surface 26, being diametrically disposed and slidably arranged in diametrically disposed parallel longitudinal bores 30 formed in the portion of the wall of the tubular body 16 terminating in the partially annular face 26. A spring 32, FIG. 5, is disposed in each bore 30 below the pin 28 disposed in the bore, and is compressed such as to normally urge the pin 28 outwardly from the partially annular face 26. Each pin 28 is locked in position by way of a set screw 34 threading through a threaded bore 36, FIG. 4, each of the set screws 34 projecting from one of the lateral surfaces 24. While the socket tubular body 16 may be made of any convenient material, preferably steel, in the same manner as a conventional socket, the pins 28 are preferably made of ground heat-treated tool steel, for engagement in the drive apertures of a steel ring, for example. It will be appreciated, however, that softer materials may be used for the pins 28 when it is desired to use the spanner socket of the invention on a cap, ring, seal, or the like made of a relatively fragile or soft material.

By means of the set screws 34, the distance to which each pin 28 projects from the surface of the partially annular end face 26 of the tubular body 16 may be conveniently and accurately adjusted, the presence of the spring 32 below each pin continuously urging the pin in a direction tending to force the pin outwardly from the bore 30. It will also be readily appreciated that in the event that the projecting portion of the pins 28 breaks off, becomes bent or worn, the pins may individually be ground off beyond the damaged portion, or new pins may be inserted in the place of the damaged or broken pins.

The remaining portion of the wall of the socket tubular body 16 may be provided with a cut-out section, as shown at 38, for the double purpose of making the tubular body 16 lighter and providing a convenient driving means for the spanner socket 10 of the invention by way of a steel bar, for example, when the spanner socket 10 is used as a tool for assembling or dismounting a readily accessible ring or other mechanical part operable by a spanner wrench.

The spanner socket 10 of the invention may be conveniently provided in sets of progressive sizes, in the same manner as socket wrenches ar provided in sets of several socket units in appropriate progressive sizes. Also, the tubular body 16 may be made with a relatively thin wall and as deep as desired to reach a ring, seal or like part through the center of which projects a stud, stub shaft, pin or bolt.

Having thus described the invention by way of a typical structural example thereof, modification whereof will be apparent to those skilled in the art, what is claimed as new is as follows:

1. A spanner socket comprising a tubular body member open at one end forming a partially annular face and having an end wall at the other end, a lateral cut-out portion forming a pair of co-planar lateral faces, disposed proximate said one end, a polygonal aperture through said end wall for engagement by a polygonal driver, a pair of adjustable cylindrical pins outwardly projecting from said at least partially annular end face, said pins being slidably and removably disposed each in one of a pair of substantially parallel longitudinal bores diametrically opposed, a compressed coil spring disposed in each of said bores below each of said pins and longitudinally urging each of said pins in a direction causing each of said pins to project from said partially annular end face, and means for locking said pins in position each in one of said bores, said means for locking said pins in position comprising a set screw for each of said pins passed through from each of said lateral surfaces through a threaded bore leading in said bore accepting said pin.

2. The spanner socket of claim 1 further comprising a radial aperture formed through said tubular body member.

3. The spanner socket of claim 1 further comprising serrations peripherally formed about a portion of said tubular member.

4. The spanner socket of claim 1 further comprising knurls peripherally formed about a portion of said tubular body member.

* * * * *